US008833599B2

(12) United States Patent
Kolon

(10) Patent No.: US 8,833,599 B2
(45) Date of Patent: Sep. 16, 2014

(54) CARRYING DEVICE FOR A KEG

(75) Inventor: Philipp Kolon, Oehringen (DE)

(73) Assignee: HUBER Packaging Group GmbH, Oehringen (DE)

( * ) Notice: Subject to any disclaimer, the term of this patent is extended or adjusted under 35 U.S.C. 154(b) by 685 days.

(21) Appl. No.: 12/613,728

(22) Filed: Nov. 6, 2009

(65) Prior Publication Data

US 2010/0116836 A1 May 13, 2010

(30) Foreign Application Priority Data

Nov. 10, 2008 (DE) ..... 10 2008 057 632

(51) Int. Cl.
*B65D 25/28* (2006.01)

(52) U.S. Cl.
CPC ..... *B65D 25/2826* (2013.01); *B65D 2525/288* (2013.01)
USPC ..... 220/763; 220/762; 220/757; 220/212.5

(58) Field of Classification Search
CPC ..... B65D 2525/288
USPC ..... 220/752, 762, 710.5, 754, 755, 757, 220/758, 776, 212.5, 318, 846, 763; 292/253, 259 B
See application file for complete search history.

(56) References Cited

U.S. PATENT DOCUMENTS 1,431,911 A * 10/1922 Jones ..... 220/288
1,904,630 A 4/1933 Robinson
1,929,433 A * 10/1933 Kenny ..... 220/767
3,297,351 A 1/1967 Hidding
3,325,044 A * 6/1967 McCutcheon ..... 220/212.5
3,401,827 A * 9/1968 Messina ..... 220/212.5
3,404,803 A * 10/1968 Hilliard ..... 220/212.5
3,520,440 A * 7/1970 Kinnavy et al. ..... 220/783
3,699,612 A * 10/1972 Hanley et al. ..... 16/405
4,170,302 A * 10/1979 Baca ..... 206/545
5,111,952 A * 5/1992 Stocchiero ..... 220/754
5,467,915 A * 11/1995 Mattson ..... 229/117.24
5,676,252 A * 10/1997 Lillelund et al. ..... 206/551

(Continued)

FOREIGN PATENT DOCUMENTS

DE 3508050 A1 9/1986
DE G9319198.7 12/1993

(Continued)

OTHER PUBLICATIONS

DE Examination Report dated Nov. 29, 2012, for related DE application.

*Primary Examiner* — Robert J Hicks
*Assistant Examiner* — Kareen Rush
(74) *Attorney, Agent, or Firm* — Bracewell & Giuliani LLP

(57) ABSTRACT

The invention discloses a carrying device for a container, in particular for a keg, having an annular cap piece that comprises at least one connecting element suited for being connected with an upper rim of the container, and having a carrying handle, extending across the annular cap piece, which in a retracted position lies flat within an outer contour of the annular cap piece and which can be moved into a usage position in which it projects beyond the top of the outer contour of the annular cap piece and can be gripped by one hand.

11 Claims, 2 Drawing Sheets

(56) References Cited

U.S. PATENT DOCUMENTS

| | | | | |
|---|---|---|---|---|
| 6,129,234 | A * | 10/2000 | Culig et al. | 220/573.1 |
| 6,561,328 | B1 | 5/2003 | Huang | |
| 6,729,491 | B2 * | 5/2004 | Morris, Jr. | 220/284 |
| 6,968,955 | B2 * | 11/2005 | Steeber | 206/702 |
| 2008/0006051 | A1 * | 1/2008 | Johnson | 62/371 |
| 2009/0145790 | A1 * | 6/2009 | Panosian et al. | 206/373 |
| 2009/0266833 | A1 * | 10/2009 | Savage et al. | 220/757 |
| 2012/0012600 | A1 * | 1/2012 | Gonzalez | 220/752 |
| 2012/0118902 | A1 * | 5/2012 | Beltrante | 220/737 |

FOREIGN PATENT DOCUMENTS

| | | | |
|---|---|---|---|
| DE | G9319198.7 | | 3/1994 |
| DE | 197 23 114 | A1 | 12/1998 |
| DE | 29812215 | U1 | 5/1999 |
| DE | 29812215 | U1 | 6/1999 |
| DE | 20 2009 009 811 | U1 | 11/2009 |
| GB | 531183 | | 12/1940 |
| GB | 531183 | A | 12/1940 |
| GB | 2 110 637 | A | 6/1983 |
| NL | 8105605 | | 12/1981 |

* cited by examiner

CARRYING DEVICE FOR A KEG

RELATED APPLICATION

This application claims priority of German patent application serial number 10 2008 057 632.8, filed Nov. 10, 2008.

TECHNICAL FIELD OF THE INVENTION

The present invention relates to a carrying device for a container, in particular a keg, having an annular cap piece that comprises at least one connecting element for connection with an upper rim of the container, and a carrying handle extending across the annular cap piece.

BACKGROUND OF THE INVENTION

In recent years, kegs filled with a beverage, such as beer, generally known as party kegs, have become more and more popular.

Such party kegs mostly have a capacity of 5 liters, 10 liters or one gallon and are normally provided with an integrated tapping system, for example a drawout tapping cock.

Such party kegs are normally supplied to the trade on pallets or in carton boxes. A carrying device is not needed in that case.

On the final consumer end, an acceptable carrying device by which one or two party kegs can be easily transported, is not available up to now.

SUMMARY OF THE INVENTION

Disclosed herein is a carrying device for a container, in particular for a keg, which allows for an easy carrying of one or more kegs.

Also disclosed is a carrying device for a keg, which is easy to manufacture.

Further disclosed is a carrying device for a keg, which allows for a comfortable carrying of a keg.

Yet further disclosed is a carrying device for a keg, which is of a particularly simple design.

Also yet further disclosed is a carrying device for a keg, which allows an easy handling.

In one exemplary embodiment, disclosed herein is a carrying device for a container, in particular for a keg, having an annular cap piece that comprises at least one connecting element suited for fixedly engaging an upper rim of a container, and having a carrying handle, extending across the annular cap piece, which in a retracted position lies flat within an outer contour of the annular cap piece and which can be moved into a usage position in which it projects beyond the top of the outer contour of the annular cap piece and can be gripped by one hand.

Alternatively, the annular cap piece on the one hand can be easily connected with the respective container while on the other hand, in its retracted position, the carrying handle is received in a recess in a manner such that it does not project beyond the outer contour of the annular cap piece. This guarantees a simple and space-saving design. In addition, a very space-saving structure and easy handling are achieved in that way.

According to a further development of the invention, the carrying handle is hinged on opposite sides of the annular cap piece.

This allows changes between the retracted position and the usage position to be effected in an easy way.

According to an advantageous further development of that embodiment, the carrying handle is fixed on the annular cap piece via film joints.

This results in an especially simple and low-cost production process.

According to another embodiment of the invention, each of the two ends of the carrying handle is connected, via a film joint, with an intermediate piece that is connected with the upper rim of the annular cap piece via a further film joint extending in parallel to the other film joint.

That feature also helps to achieve a simple and low-cost structure and easy handling.

According to another embodiment of the invention, the annular cap piece comprises locking elements for connection with the upper rim of a container.

One thereby arrives at an especially easy way of fastening the carrying device on the container.

The locking elements may be designed as locating hooks, for example, that can be locked against the upper rim of the container.

According to another embodiment of the invention, the carrying device is made as an injection-molded plastic part.

This results in an especially simple and low-cost production process.

According to another embodiment of the invention, the annular cap piece is designed for being stackable in the retracted position of the carrying handle.

This permits especially space-saving handling of a plurality of carrying handles.

According to an additional further development of the invention, the design of the annular cap piece is such that when connected with a respective container, stacking with a further container is possible in the retracted position of the carrying handle.

This also provides advantages in use due to easier handling.

BRIEF DESCRIPTION OF THE DRAWINGS

Further features and advantages of the invention will become apparent from the description that follows of a preferred embodiment, with reference to the drawing. In the drawing.

DETAILED DESCRIPTION OF THE PREFERRED EMBODIMENT

Figure 1:
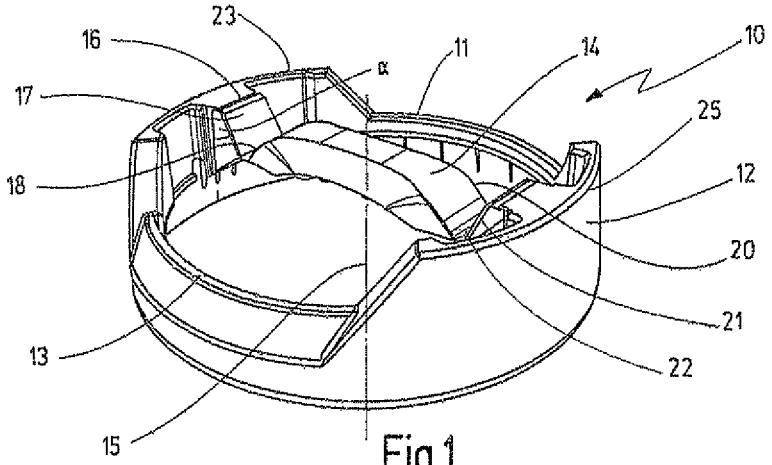
FIG. 1 shows a perspective representation, viewed obliquely from above, of a carrying device according to the invention with the carrying handle in its retracted position.
Figure 2:
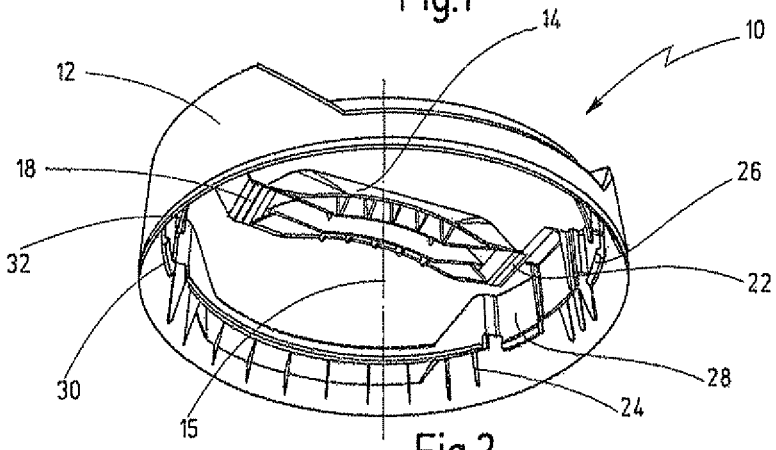
FIG. 2 shows a perspective representation, viewed obliquely from below, of a carrying device according to FIG. 1.

In FIG. 1, a carrying device according to the invention is indicated generally by reference numeral 10. The carrying device 10 comprises an annular cap piece 12 designed for being fitted on an upper rim 42 of a respective container 40 in the form of a party keg with a capacity of 5 liters (compare FIG. 4).

The side wall of the annular cap piece 12 is provided with two oppositely arranged recesses 11, 13 which enclose between them on each side a raised section 23, 25, respectively. A carrying handle 14 extending between the raised sections 23, 25 has each of its two ends connected with the side of the raised section 23 or 25 (the upside) that faces away from the keg, via a film joint 18, 22 and an intermediate piece 17, 21, respectively, and a further film joint 16, 20. The film joints 16, 18 and 20, 22, respectively, are arranged one parallel to the other.

In the position illustrated in FIG. 1, the carrying handle 14 is in its retracted position in which the carrying handle 14 is received flush within the outer contour of the annular cap piece 12. In that position, the two intermediate pieces 17, 21 are obliquely inclined between the film joints 18, 22 on, the carrying handle 14 and the film joints 16 or 20, respectively. In that retracted position, an angle a of approximately 30° is enclosed between the intermediate pieces 17, 20 and an axis that extends in parallel to the center axis 15.

Figure 4:
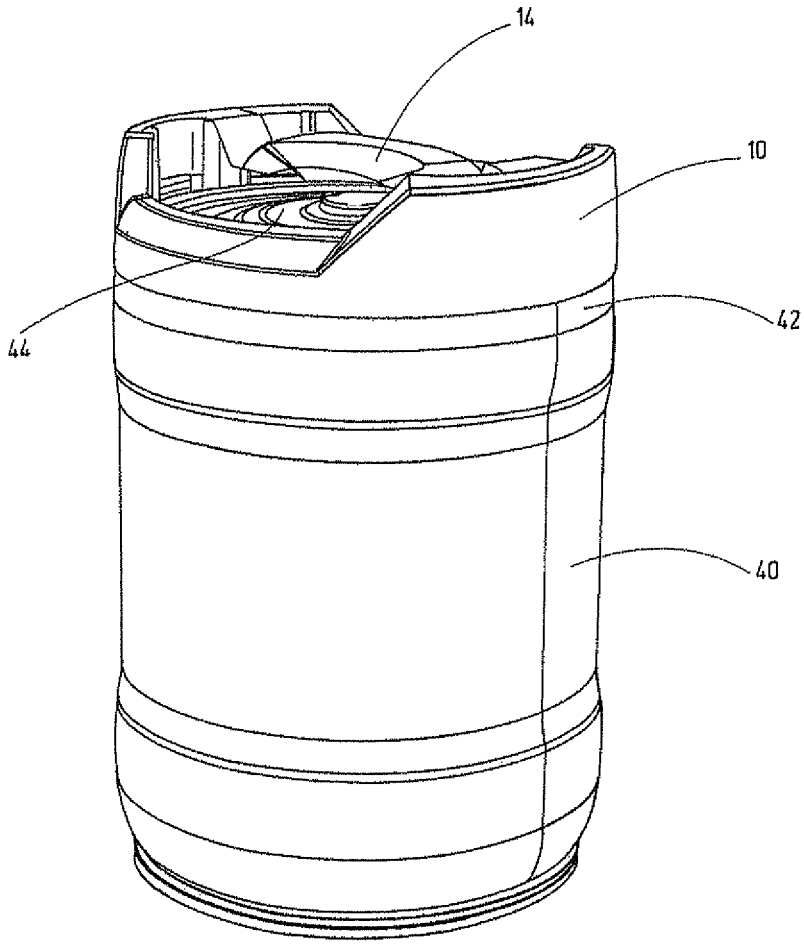
FIG. 4 shows a perspective representation of a carrying device according to FIG. 1 mounted on an associated container.

The carrying device 10 is produced as an injection-molded part from a suitable plastic material, such as polypropylene, and is reinforced on its bottom by a plurality of reinforcing ribs 24. There are further provided on the bottom, on each side of the carrying handle 14, two locating hooks 26, 28 the arrangement and design of which is such that the carrying device 12 can be placed on the upper rim 42 of a respective container 40 from above and can be pressed down to lock it against the upper rim 42, whereby the locating hooks 26, 28 or 30, 32 engage below the beaded edge (not shown) of the upper rim 42 thereby safely locking the carrying device 10 against the upper rim 42. In the mounted and locked condition illustrated in FIG. 4, the beaded edge (not shown) of the upper rim 42 is received flush within the outer contour of the annular cap piece 12. As can be seen in FIG. 4, only a relatively small space, not sufficient to fully grip the handle by one hand, remains between the handle 14 and the upper surface 44 of the container 40 in the retracted position of the carrying handle 14. In the illustrated position, the carrying handle 14 is received flush within the outer contour of the annular cap piece 12 so that the bottom of a further container can be stacked on the carrying device 10 from above.

Figure 3:
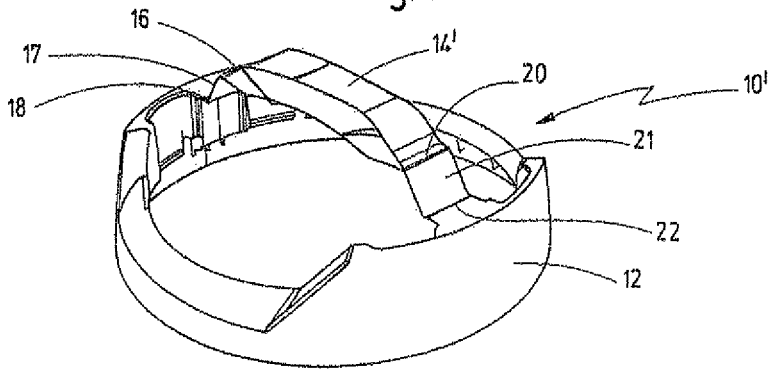
FIG. 3 shows a perspective representation of the carrying device according to FIG. 1, with the carrying handle in a usage position.

Now, when the carrying handle 14 is to be gripped, it can be gripped in its retracted position by two or more fingers and can be pulled up into the position illustrated in FIG. 3. As a rule, this is effected by first pulling up one end of the carrying handle 14 so that the two film joints 20, 22 or 16, 18 are moved to bring the associated intermediate piece 21 or 17, respectively, into an upwardly inclined position. Then the other end of the carrying handle 14 is pulled up so that the opposite film joints likewise move upward whereby the associated intermediate piece 17 or 21, respectively, assumes an upwardly inclined position. Now the carrying handle 14 is in its usage position in which the carrying handle 14 projects beyond the top of the outer contour of the annular cap piece 12. In that position, which is indicated by 14' in FIG. 3 for the carrying device 10', the carrying handle 14' of the carrying device can then be fully gripped by one hand. So, the container 40 can be easily carried by one hand gripping the carrying handle, It is possible in this way to carry one container by one hand, or two containers simultaneously by two hands.

The carrying device 10 as such is stackable so that in the retracted position of the carrying handle 14 a plurality of carrying devices 10 can be stacked one on top of the other. To this end, the annular cap piece 12 is given a corresponding conicity on its outside.

What is claimed is:

1. A carrying device for a keg, comprising:

an annular cap piece having a downside facing said keg and an upside opposite said keg;

a plurality of locking elements arranged on said downside and being configured for engaging an upper rim of said keg and for locking therewith;

a carrying handle arrangement extending across said annular cap piece, said carrying handle arrangement comprising a carrying handle having two ends and extending along a first direction therebetween, each end being connected with a separate one of a pair of intermediate pieces, each intermediate piece connected to a different one of the two ends via a corresponding first film hinge and connected directly to an upper rim of said annular cap piece via a corresponding second film hinge extending in parallel to said first film hinge, thereby allowing movement of said carrying handle between a retracted position and a usage position;

wherein said carrying handle arrangement is configured so that, when being in said retracted position, the carrying handle is arranged sunk within an outer contour of said annular cap piece;

wherein said carrying handle arrangement is configured so that, when the carrying handle is in said usage position, the carrying handle projects outwardly beyond said outer contour of said annular cap piece, thereby allowing gripping around said carrying handle by one hand;

wherein said upper rim of said annular cap piece comprises a tilted outer wall, thereby allowing a stacking of carrying devices one on top of another when said carrying handle is in said refracted position;

wherein each film hinge extends along a film hinge axis defined by the respective film hinge, each film hinge axis extending substantially perpendicular to said first direction; and wherein each film hinge is configured for hinging about the respective film hinge axis.

2. The carrying device of claim 1, wherein said carrying handle is hingedly connected to opposite sides of said annular cap piece.

3. The carrying device of claim 1, wherein said locking elements are configured as latching elements for latching engagement with said upper rim of said keg.

4. The carrying device of claim 3, wherein said latching elements are configured as locating hooks that can be locked against said upper rim of said keg.

5. The carrying device of claim 1, being configured as an injection molded plastic part, and wherein the annular cap piece comprises a sidewall and a pair of oppositely arranged recesses extending therein and arranged substantially lateral to an extent of the carrying handle.

6. The carrying device of claim 5, wherein said annular cap piece when connected with said keg, is configured for stacking with another keg when the carrying handle is in said retracted position.

7. The carrying device of claim 1, being configured as an injection-molded plastic part.

8. The carrying device of claim 1, wherein said annular cap piece when connected with said keg, is configured for stacking with a further container when the carrying handle is in said refracted position.

9. The carrying device of claim 1, wherein said locking elements are configured as locating hooks that can be locked against said upper rim of said keg.

10. The carrying device of claim 8, wherein said locking elements are configured as locating hooks that can be locked against said upper rim of said keg.

11. The carrying device of claim 1, wherein the first and second film hinges are configured so that the carrying handle retracts into said retracted position and extends into said usage position along a pathway substantially normal to a plane extending through the outer contour of said annular cap piece.

* * * * *